US009147520B2

(12) United States Patent
Roy Martín et al.

(10) Patent No.: US 9,147,520 B2
(45) Date of Patent: Sep. 29, 2015

(54) DRY-TYPE TRANSFORMER

(75) Inventors: Carlos Roy Martín, Zaragoza (ES); Antonio Nogués Barrieras, Sariñena (ES)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 14/241,856

(22) PCT Filed: Aug. 27, 2012

(86) PCT No.: PCT/EP2012/066568

§ 371 (c)(1),
(2), (4) Date: Feb. 27, 2014

(87) PCT Pub. No.: WO2013/030139

PCT Pub. Date: Mar. 7, 2013

(65) Prior Publication Data

US 2014/0218151 A1 Aug. 7, 2014

(30) Foreign Application Priority Data

Aug. 30, 2011 (EP) ..... 11179279

(51) Int. Cl.
*H01F 29/02* (2006.01)
*H01F 27/28* (2006.01)
*H01F 27/34* (2006.01)

(52) U.S. Cl.
CPC ..... *H01F 29/025* (2013.01); *H01F 27/2847* (2013.01); *H01F 27/2871* (2013.01); *H01F 27/346* (2013.01); *H01F 2027/348* (2013.01)

(58) Field of Classification Search
CPC ..... H01F 27/00–27/30
USPC ..... 336/55–62, 180–184
See application file for complete search history.

(56) References Cited

U.S. PATENT DOCUMENTS 3,925,743 A * 12/1975 Van Nice ..... 336/70
4,554,523 A * 11/1985 Miki et al. ..... 336/70
4,864,266 A 9/1989 Feather et al.

(Continued)

FOREIGN PATENT DOCUMENTS

DE 2609548 A1 12/1976
DE 3214171 A1 11/1982

OTHER PUBLICATIONS

International Search Report (ISR) and Written Opinion, International Application No. PCT/EP2012/066568, International Filing Date Aug. 27, 2012, Date of Mailing ISR Dec. 13, 2012, 12 pages, European Patent Office, Rijswijk Netherlands.

(Continued)

*Primary Examiner* — Tuyen Nguyen
(74) *Attorney, Agent, or Firm* — Peter B. Scull; Hamilton, DeSanctis & Cha LLP

(57) ABSTRACT

A dry-type transformer comprises a winding with a tapping zone, the tapping zone being the zone wherein at least two connections can be made, allowing to change the number of turns of the winding and thus change the turn ratio of the transformer, and with at least a first non-tapping zone, wherein the winding comprises a conductor having, in at least part of the tapping zone, a first width in the axial direction of the winding, and having, in at least part of the first non-tapping zone, a second width in the axial direction of the winding, the first width being smaller than the second width.

14 Claims, 2 Drawing Sheets

(56) References Cited

U.S. PATENT DOCUMENTS

| | | | | |
|---|---|---|---|---|
| 6,867,674 | B1 * | 3/2005 | Schutte et al. | 336/180 |
| 7,233,223 | B2 * | 6/2007 | Darmann | 336/180 |
| 7,719,397 | B2 * | 5/2010 | Pauley et al. | 336/55 |

OTHER PUBLICATIONS

European Opinion and Annex to the European Search Report on European Patent Application No. EP11179279, Date of Mailing Mar. 6, 2012, 6 pages, European Patent Office, Munich, Germany.

* cited by examiner

DRY-TYPE TRANSFORMER

The present invention relates to a dry-type transformer comprising a winding with a tapping zone, with reduced losses in said winding.

BACKGROUND ART

Dry-type transformers for high voltage classes have been widely used in recent years in a number of utility and industrial installations because of their high reliability. Some of these dry-type transformers require the use of high voltages, high rated powers and a high regulating range, which lead to heating and hot-spot problems related to eddy and DC (or ohmic) losses in the windings of the transformer, These eddy currents are induced by the magnetic flux generated by the current flowing through the winding, and they depend mainly on the module and direction of the magnetic flux: generally, it can be said that the more radial the magnetic flux, the higher the losses.

Also, in dry-type transformers requiring a high tapping range, when working in the lowest position of the transformer's tap-changer, high losses appear in the parts of the winding near to the connection points of the tap-changer, leading to a high hot-spot temperature within the zones surrounding said connection points.

In oil-type transformers, a regulation winding is employed to decrease hot spots created by the eddy currents along the winding; however, such a regulation winding may not be a suitable or appropriate solution for a dry-type transformer, since, because of its air-cooling system, it would require adding a very large and expensive regulation coil to the dry-type transformer.

The present invention aims to provide a dry-type transformer which solves at least partly the above drawbacks, by reducing the losses due to eddy currents, at least in the more problematic operating positions of the tap changer.

SUMMARY OF THE INVENTION

In a first aspect, the invention provides a dry-type transformer comprising a winding with a tapping zone, the tapping zone being the zone wherein at least two connections can be made, allowing to change the number of turns of the winding and thus change the turn ratio of the transformer, and with at least a first non-tapping zone, wherein the winding comprises a conductor having, in at least part of the tapping zone, a first width in the axial direction of the winding, and having, in at least part of the first non-tapping zone, a second width in the axial direction of the winding, the first width being smaller than the second width.

The use of a conductor having such a smaller width in the tapping zone reduces the axial length of this zone, and in particular reduces the gap of unused turns in the lower position of the tap changer of the transformer, i.e. the position in which the winding has a smaller number of turns. This reduction in the gap brings about a more axial magnetic flux, reducing the radial component thereof; as a consequence of this change in the magnetic flux, the eddy currents and corresponding losses caused by the radial magnetic flux in those non-tapping zones of the windings that are adjacent to the tapping zone are reduced.

Additional objects, advantages and features of embodiments of the invention will become apparent to those skilled in the art upon examination of the description, or may be learned by practice of the invention.

BRIEF DESCRIPTION OF THE DRAWINGS

Particular embodiments of the present invention will be described in the following by way of non-limiting examples, with reference to the appended drawings, in which.

DETAILED DESCRIPTION OF EMBODIMENTS

Figure 1:
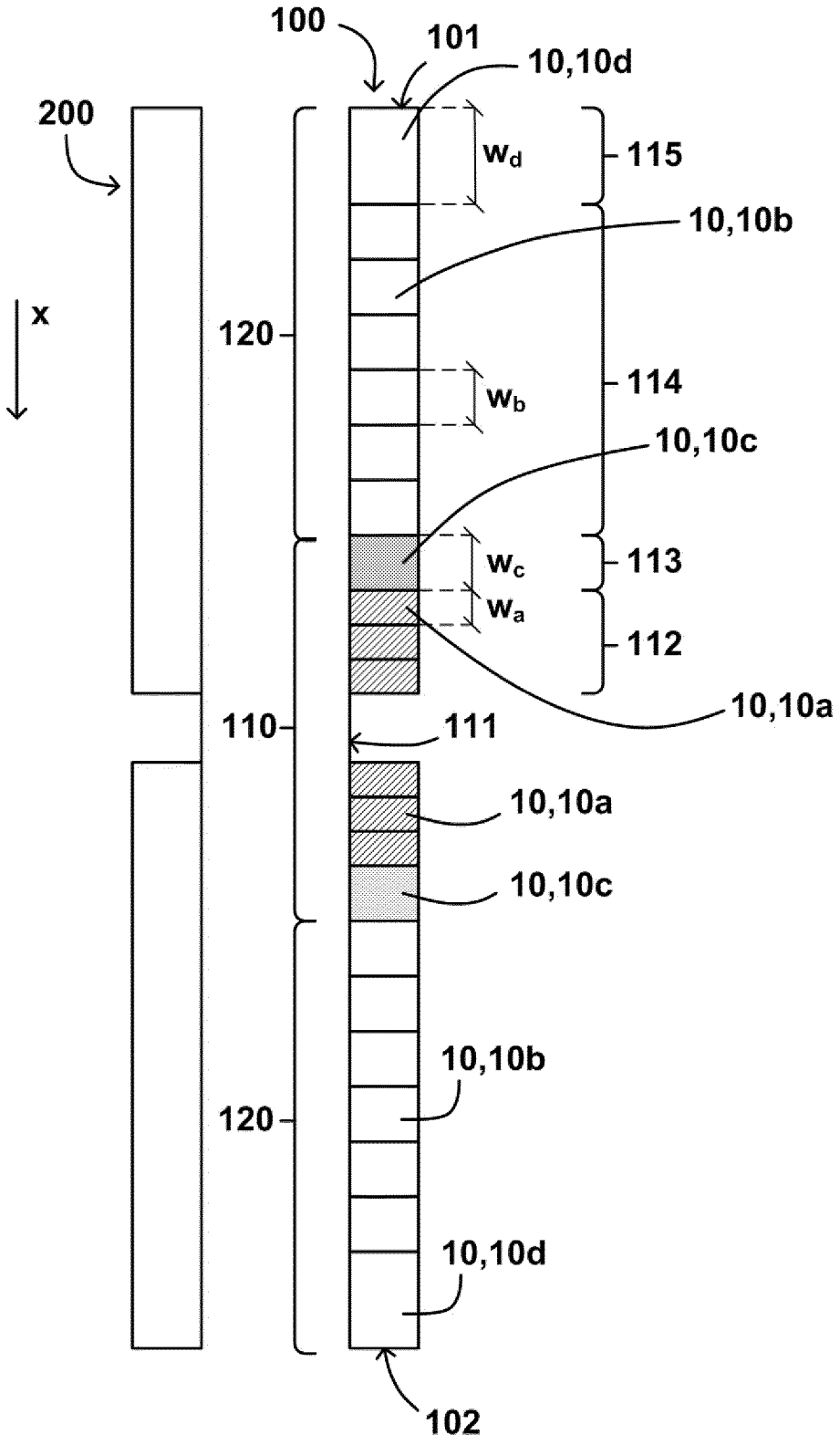
FIG. 1 depicts schematically a dry-type transformer comprising a high voltage winding and a low voltage winding, according to an embodiment of the present invention.

FIG. 1 shows schematically a dry-type transformer according to an embodiment of the present invention. More particularly, it shows schematically the arrangement of the windings of a transformer, according to a partial section taken along a plane that contains the axis of the windings.

Dry type transformers according to embodiments of the present invention may be of the type wherein the transformer is designed to operate with a certain rated current flowing through the high voltage (HV) winding. Therefore, substantially the same current flows through all the conductors forming the winding, even if the winding may comprise several conductors in series with different physical features.

The transformer may comprise an HV winding 100 and a low voltage (LV) winding 200 inductively coupled with the HV winding, each winding comprising a conductor, and both windings being displayed in the figure in a usual arrangement wherein the LV winding is mounted coaxially inside the HV winding; the HV winding 100 may comprise a tapping zone 110, two non-tapping zones 120, and a tap-changer (not shown) which allows changing the turn ratio of the windings, in order to change the transforming relation of the dry type transformer. The tap-changer may comprise two connectors (not shown) which are connectable at different points of the conductor along the tapping zone 110 of the HV winding 100, so as to exclude a plurality of turns of the HV winding, thus enabling a change in the turn ratio of the transformer.

It has to be noted that the conductor forming the HV winding may be formed by, for example, a plurality of conducting parts connected to each other by welding or using a connecting part, such as, for example, a non-conducting part engaging both conducting parts together to allow a suitable current flow through them.

By way of example, in FIG. 1, according to this specific embodiment, the HV winding 100 may be formed by two sub-winding structures 101, 102, connected to each other at an intermediate point 111 of the tapping zone 110. However, other embodiments may comprise a HV winding in a single structure, or more than two sub-winding structures, depending on the physical structure of the windings used to configure the transformer.

Figure 2:
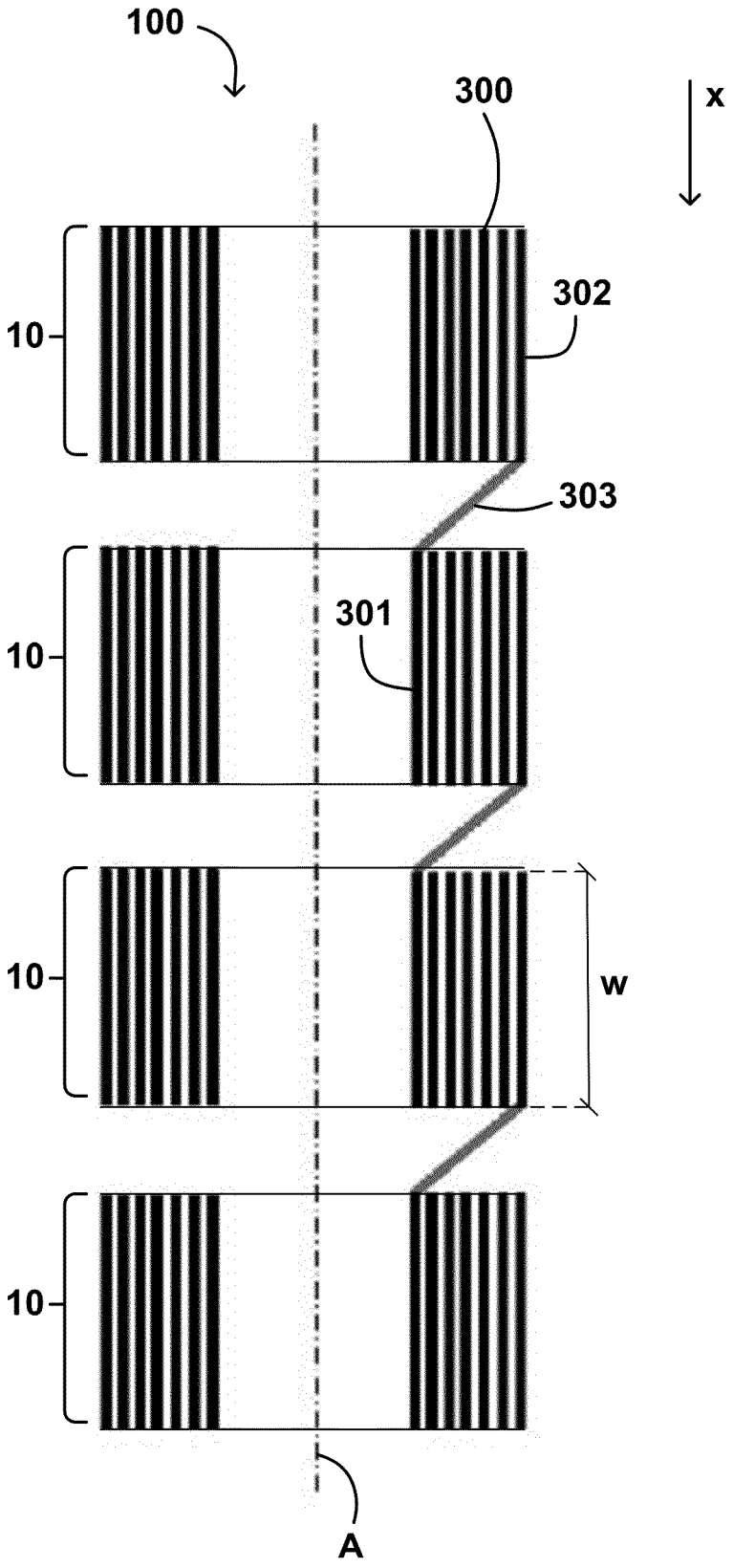
FIG. 2 depicts schematically the conductors of a high voltage winding of a dry-type transformer, according to an embodiment of the present invention.

FIG. 2 shows schematically a portion of the HV winding of a transformer, according to a section taken along a plane that contains the axis (A) of the windings.

According to FIG. 2, the conductor forming the HV winding 100 may be shaped as a strip 300 having a width w, which may be arranged forming a plurality of spiral-shaped "disks" 10, the strip-shaped conductor having within each disk a uniform width in the axial direction of the winding. Furthermore, the disks may be interconnected with each other, and the spiral in each disk may have an inner strip end 301 and an outer strip end 302. Each spiral-shaped disk 10 may be connected with the adjacent ones by means of a suitable electric coupling 303 connecting the outer strip end 302 of each disk to the inner strip end 301 of the following disk in such a way that the disks are connected in series forming the winding 100. FIG. 2 shows four of such disks 10 connected to each other.

Furthermore, as seen in FIG. 1, at least a portion 112 of the disks 10*a* in the tapping zone 110 may be configured in such a way that they comprise a strip-shaped conductor having a smaller width $w_a$, in the axial direction of the winding (direction x), than the width $w_b$ of the strip-shaped conductor of the disks 10*b* of the non-tapping zone 120. The portion of the disks 10*a* having a conductor with such a width $w_a$ is shown with reference 112 in FIG. 1, and the portion of the disks 10*b* having a conductor with such a width $w_b$ are shown with reference 114 in FIG. 1.

In this way the axial length of the tapping zone is reduced, thus reducing the gap of unused turns when the tap-changer works at a low range, i.e. the position in which the winding has a lower number of turns. This reduction allows reducing the losses related to the eddy currents caused by the radial magnetic flux in those non-tapping zones 120 of the windings adjacent to the tapping zone 110.

According to an embodiment, the disks 10*a* of the tapping zone 110 may have a conductor with a width $w_a$ in the axial direction of the HV winding 100 which may be between 40% and 80% of the width $w_b$ of the disks of the non-tapping zone 120, and may preferably be approximately 60% of the width of the disks of the non-tapping zone 120.

Also, according to an embodiment, the conductors of the disks 10*a*, 10*c* of the tapping zone 110 are made of a material with a higher conductivity than the materials used on the disks 10*b*, 10*d* of the non-tapping zones 120.

This improves the efficiency of the transformer when it is working with a high range in the tap changer, i.e. the position in which the winding has a higher number of turns: in this position, ohmic losses appear in the disks 10*a*, 10*c* of the tapping zone 110, and this losses may be relevant in disks having a relatively small width, since ohmic losses will depend proportionally on the size of the conductor. Such losses can be reduced by using disks 10*a*, 10*c* with higher conductivity in the tapping zone 110.

According to some embodiments, the disks 10*a*, 10*c* of the tapping zone 110 may be made of copper, and the disks 10*b*, 10*d* of the non-tapping zones 120 may be made of aluminum.

Using smaller disks in the tapping zone leads to a reduction of the losses when the tap changer works at a lower range, and making these disks of copper reduces the losses due to said reduction of the size of the disks, when the tap changer works at a higher range.

Furthermore, the conductor of a portion of the disks 10*c* at the ends of the tapping zone 110 adjacent to the non-tapping zones 120 may have a width $w_c$ higher than $w_a$. This relatively higher width allows reducing the DC or ohmic losses in the disks 10*c*, in order to compensate the overall losses, which also comprise eddy losses, in the disks 10*c*, when the transformer is working at a high range in the tap changer. The portion of the disks 10*c* having a conductor with such a width $w_c$ is shown with reference 113 in FIG. 1 (in the example, only one disk 10*c* in each winding structure is shown).

Also, according to an embodiment, the conductor of a portion of the disks 10*d* at the ends of the non-tapping zones 120 remote from the tapping zone 110, may also have a width $w_d$ bigger than $w_b$. In this way, a reduction of DC or ohmic losses is achieved in said disks 10*d*, in order to compensate the eddy losses caused by the radial magnetic flux in the ends of the non-tapping zones remote from the tapping zone. The portion of the disks 10*d* having such a width $w_d$ is shown with reference 115 in FIG. 1 (in the example, only one disk 10*d* in each winding structure is shown).

It will be noted that each of the above features regarding the width and material of the conductor may be implemented in a dry-type transformer independently from each other, since each provides an effect that is not dependent on the others, although the combined effects may be advantageous.

According to experimental results, in a HV coil of a 25 MVA 66 kV transformer with a tapping range of ±18%, a reduction of approximately 40% of the losses caused by eddy currents has been achieved when the transformer is working at the lower position of the tap changer, and the relations between the widths are: $w_a$ is 60% of $w_b$, $w_c$ is the same as $w_b$, and $w_d$ is 120% of $w_b$. Most of said reduction is found in the disks of the non-tapping zone (120) adjacent to the tapping zone (110), where a reduction of the hot spot temperature has been achieved from 210° C. to 116° C.

Although only a number of particular embodiments and examples of the invention have been disclosed herein, it will be understood by those skilled in the art that other alternative embodiments and/or uses of the invention and obvious modifications and equivalents thereof are possible. Furthermore, the present invention covers all possible combinations of the particular embodiments described. Reference signs related to drawings and placed in parentheses in a claim, are solely for attempting to increase the intelligibility of the claim, and shall not be construed as limiting the scope of the claim. Thus, the scope of the present invention should not be limited by particular embodiments, but should be determined only by a fair reading of the claims that follow.

The invention claimed is:

1. Dry-type transformer comprising a winding with a tapping zone, the tapping zone being the zone wherein at least two connections can be made, allowing to change the number of turns of the winding and thus change the turn ratio of the transformer, and with at least a first non-tapping zone, wherein the winding comprises a conductor having, in at least part of the tapping zone, a first width in the axial direction of the winding, and having, in at least part of the first non-tapping zone, a second width in the axial direction of the winding, the first width being smaller than the second width wherein the conductor of the winding is made of at least two materials with different conductivity; wherein a material with higher conductivity of the at least two materials is used in the conductor in the tapping zone where there is a smaller width.

2. Dry-type transformer according to claim 1, wherein the conductor of the winding in at least part of the tapping zone is made of a first material and the conductor of at least part of the rest of the winding is made of a second material.

3. Dry-type transformer according to claim 1, wherein the two materials are copper and aluminum.

4. Dry-type transformer according to claim 3, wherein the conductor of the winding in at least part of the tapping zone is made of copper, and the conductor of the winding in at least part of the non-tapping zone is made of aluminum.

5. Dry-type transformer according to claim 1, wherein a length of the conductor in the tapping zone adjacent to a non-tapping zone has a third width, in the axial direction of the winding, which is different with respect to the first width of the conductor.

6. Dry-type transformer according to claim 5, wherein said third width is higher than the first width of the conductor.

7. Dry-type transformer according to claim 5, wherein the third width is approximately equal to the second width.

8. Dry-type transformer according to claim 1, wherein the first width is one of between 40% and 80% of the second width, and approximately 60% of the second width.

9. Dry-type transformer according to claim 1, wherein at least part of the conductor is shaped as a strip.

10. Dry-type transformer according to claim 9, wherein the conductor is arranged forming a plurality of spiral-shaped disks, the strip-shaped conductor having within each disk a uniform width in the axial direction of the winding.

11. Dry-type transformer according to claim 10, wherein the strip-shaped conductor is made of the same material within each disk.

12. Dry-type transformer according to claim 1, wherein a length of the conductor at the end of a non-tapping zone remote from the tapping zone has a fourth width in the axial direction of the winding, which is different with respect to the second width of the conductor.

13. Dry-type transformer according to claim 12, wherein the fourth width is higher than the second width of the conductor.

14. Dry-type transformer according to claim 1, wherein the winding is the high voltage winding of the transformer.

* * * * *